US006220117B1

(12) United States Patent
Butcher

(10) Patent No.: US 6,220,117 B1
(45) Date of Patent: Apr. 24, 2001

(54) METHODS OF HIGH TEMPERATURE INFILTRATION OF DRILL BITS AND INFILTRATING BINDER

(75) Inventor: Trent N. Butcher, Sandy, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/135,977

(22) Filed: Aug. 18, 1998

(51) Int. Cl.[7] ..... B21K 5/04
(52) U.S. Cl. ..... 76/108.2; 175/425
(58) Field of Search ..... 76/108.2; 175/425

(56) References Cited

U.S. PATENT DOCUMENTS

| | | | | |
|---|---|---|---|---|
| 2,833,638 | | 5/1958 | Owen . | |
| 3,175,260 | | 3/1965 | Bridwell et al. . | |
| 3,757,878 | * | 9/1973 | Wilder et al. | 175/329 |
| 3,757,879 | | 9/1973 | Wilder et al. . | |
| 3,775,237 | | 11/1973 | Crowley . | |
| 3,778,238 | | 12/1973 | Tyler et al. . | |
| 3,800,891 | | 4/1974 | White et al. . | |
| 3,880,678 | | 4/1975 | Shapiro et al. . | |
| 3,972,712 | | 8/1976 | Renschen . | |
| 4,003,715 | | 1/1977 | Cascone . | |
| 4,274,840 | | 6/1981 | Housman . | |
| 4,289,946 | | 9/1981 | Yarwood et al. . | |
| 4,389,074 | | 6/1983 | Greenfield . | |
| 4,423,646 | | 1/1984 | Bernhardt . | |
| 4,499,795 | * | 2/1985 | Radtke | 76/108 A |
| 4,608,226 | * | 8/1986 | Lauvinerie et al. | 419/5 |
| 4,669,522 | | 6/1987 | Griffin . | |
| 4,780,274 | | 10/1988 | Barr . | |
| 5,000,273 | | 3/1991 | Horton et al. . | |
| 5,145,506 | | 9/1992 | Goldstein et al. . | |
| 5,150,636 | | 9/1992 | Hill . | |
| 5,290,507 | | 3/1994 | Runkle . | |
| 5,337,844 | | 8/1994 | Tibbitts . | |
| 5,373,907 | | 12/1994 | Weaver . | |
| 5,433,280 | | 7/1995 | Smith . | |
| 5,441,121 | | 8/1995 | Tibbitts . | |
| 5,453,105 | | 9/1995 | Middlemiss et al. . | |
| 5,544,550 | | 8/1996 | Smith . | |
| 5,589,268 | | 12/1996 | Kelley et al. . | |
| 5,662,183 | | 9/1997 | Fang . | |
| 5,674,620 | | 10/1997 | Puiia et al. . | |
| 5,740,872 | | 4/1998 | Smith . | |
| 5,839,329 | * | 11/1998 | Smith et al. | 76/108.2 |
| 6,089,123 | * | 7/2000 | Chow et al. | 76/108.2 |

OTHER PUBLICATIONS

SU 356046 Abstract 1973 No month data!.

* cited by examiner

*Primary Examiner*—Daniel Jenkins
(74) *Attorney, Agent, or Firm*—Trask Britt

(57) ABSTRACT

A method of manufacturing a bit body, other drilling-related component, or other article of manufacture, including fabricating a particulate-based matrix and infiltrating the particulate-based matrix with a binder that includes cobalt or iron. The binder may be a cobalt alloy or an iron alloy. The particulate-based matrix may be disposed within a non-graphite mold. The particulate-based matrix and binder are placed within an induction coil and an alternating current is applied to the induction coil in order to directly heat the binder, permitting the binder to infiltrate or otherwise bind the particles of the matrix together. The molten binder may then be directionally cooled by forming a cooling zone around an end portion of the bit body and increasing the size of the cooling zone relative to the bit body. The invention also includes a bit body, other drilling-related component, or other article of manufacture which includes a particulate-based matrix that is bound together with a binder that includes iron or cobalt.

7 Claims, 6 Drawing Sheets

METHODS OF HIGH TEMPERATURE INFILTRATION OF DRILL BITS AND INFILTRATING BINDER

BACKGROUND OF THE INVENTION

1. Field of the Invention

The present invention relates to processes for infiltrating metal matrices with a binder. In particular, the present invention relates to processes for infiltrating tungsten carbide matrices with metal or metal alloy binders. More specifically, the present invention relates to processes for manufacturing earth boring drill bits which include infiltrating a tungsten carbide matrix with a high-strength metal or metal alloy binder.

2. Background of Related Art

Conventionally, earth boring drill bits that include a powdered or particulate refractory material matrix, which are also referred to as particulate-based drill bits, have been manufactured by processes such as sintering and infiltration. Conventional infiltration techniques typically include the formation of a somewhat porous matrix of powdered or particulate material and the infiltration thereof by powder metallurgy processes. U.S. Pat. No. 3,757,878, which issued to Wilder et al. on Sep. 11, 1973, and U.S. Pat. No. 4,780,274, which issued to Barr on Oct. 25, 1988, each disclose exemplary powder metallurgy techniques that have been conventionally employed to produce infiltrated drill bits. In these powder metallurgy processes, a wear-resistant matrix powder, such as a tungsten carbide powder, is placed into a carbon or graphite mold, forming a particulate-based bit body matrix therein. A steel bit blank is typically inserted into the mold and partially within the particulate-based matrix.

The mold is then placed into a furnace, and a funnel having an infiltrating alloy therein, which is typically referred to as a binder or infiltrant, is placed in the furnace and positioned over the mold. As the furnace is heated, the binder melts and is introduced into the mold. The molten binder penetrates the porous matrix by capillary action and gravity, filling the spaces, or pores, between the matrix powder particles. Conventional furnaces, which heat the mold, funnel and the contents thereof without radiated heat, are typically employed in such infiltration processes. The use of conventional furnaces is, however, somewhat undesirable from the standpoint that a relatively long period of time is typically required when radiated heat is employed to heat the funnel, mold and binder to a temperature that is sufficient to effect infiltration of the porous matrix.

Conventionally, copper-based alloys have been employed to bind matrices which include tungsten carbide particles. Copper-based binders typically have a melting temperature of about 1,065° C. to about 1,200° C. U.S. Pat. No. 5,000,273, which issued to Horton et al. on Mar. 19, 1991, discloses a copper-based alloy binder having a melting temperature of less than 1,050° C. The use of binders with as low melting temperatures as possible is typically desired in order to facilitate the attachment of thermally stable polycrystalline diamond compacts (PDCs) to the bit body during infiltration.

The infiltrated matrix is then cooled. Upon cooling, the infiltrating alloy binder solidifies, binding the matrix powder particles together to form a bit body, and binding the bit body to the steel blank to form a drill bit. Typically, cooling begins at the periphery of the infiltrated matrix and continues inwardly, with the center of the bit body cooling at the slowest rate. Thus, even after the surfaces of the infiltrated bit body matrix have cooled, a pool of molten binder may remain in the center of the bit body, which may generate stress gradients, such as shrinkage porosity or cracks, through the infiltrated matrix, which will likely weaken or damage the bit body.

After the bit body has cooled, a threaded connection may be machined on, attached to, or otherwise associated with the steel blank of the drill bit in order to permit attachment of the drill bit to a drill string. Similarly, cutters and gage trimmers, both of which are typically made of natural diamond or synthetic diamond (e.g., PDCs), nozzles, or any other components that are associated with a finished drill bit may be attached to the bit body or otherwise associated therewith. Such components are typically attached to or associated with infiltrated bit bodies by brazing or welding. Thermally stable PDCs, which are typically referred to as thermally stable products (TSPs), may be assembled with the particulate-based bit body prior to infiltration, and attached thereto or associated therewith during infiltration by the infiltrating binder.

As noted previously, copper alloys may be employed as a binder in infiltrated tungsten carbide bit bodies. Conventional copper infiltrated tungsten carbide bit bodies have high wear-resistance and high erosion-resistance relative to steel bit bodies, and copper-based alloys may be melted at temperatures which permit attachment of cutting elements comprising TSPs to the particulate-based bit body during infiltration thereof. Copper and the copper alloys that are typically employed to infiltrate drill bits are relatively low strength, low-toughness materials. Typically, a copper alloy that may be used to infiltrate a tungsten carbide bit body matrix will withstand up to approximately 30 in-lbs of impact without fracturing, as measured by the Charpy impact strength test. The toughness of the copper alloy infiltrated tungsten carbide bit bodies is even lower when measured by the Charpy impact strength test (e.g., about 2 ft-lbs, Charpy unnotched) or the transverse rupture strength test, and when compared with the strength of the copper alloy itself. Copper alloy-infiltrated tungsten carbide bit bodies can also crack upon being subjected to the impact forces that are typically encountered during drilling. Additionally, thermal stresses from the heat generated during fabrication of the bit or during drilling may cause cracks to form in the bit body. Typically, such cracks occur where the cutting elements have been secured to the matrix body. If the cutting elements are sheared from the drill bit body, the expensive diamonds on the cutter element are lost, and the bit may cease to drill.

U.S. Pat. No. 5,662,183 (the "'183 patent"), which issued to Zhigang Fang on Sep. 2, 1997, discloses an alternative, high-strength binder material and method of infiltrating a matrix of particulate refractory material, such as tungsten carbide, with the binder. The high-strength binder of the '183 patent includes a cobalt-, nickel-, or iron-based alloy. As is known to those in the art, however, cobalt and iron, when molten, may dissolve, or "attack," carbon. Thus, during infiltration of the porous matrix with binders which include significant amounts of these metals, the graphite funnels and molds that are typically employed in the infiltration of tungsten carbide bit bodies may be attacked and destroyed by cobalt, iron, or metal alloys which include these metals during exposure thereto. Increased amounts of damage to the funnel and mold may occur with prolonged exposure to binders which include cobalt or iron. Such damage to the graphite mold may result in an undesirably shaped bit body. Consequently, the product yield of bit bodies that include cobalt- or iron-based alloy binders and that are infiltrated in graphite molds may be low, or the bit bodies may require further processing, such as machining, to remove excess material from the bit face. Lower product yields and additional processing both increase manufacturing costs.

The infiltration method of the '183 patent includes coating the graphite funnel and mold with hexagonal-structure boron nitride (HBN) in order to prevent metals such as nickel, cobalt, or iron from attacking the graphite. Nevertheless, HBN does not completely prevent metals such as cobalt and iron from attacking the graphite. Thus, the use of HBN may not significantly increase product yields or significantly decrease manufacturing costs. Moreover, in order to adequately protect the graphite mold, the layer thickness of the coating material would likely be relatively thick, which would likely alter the dimensions and cutter placement of a drill bit to be defined thereby.

A method of infiltrating a refractory material matrix with a binder which includes cobalt or iron and which reduces or eliminates any damage that may be caused to the mold by the molten binder is needed, as well as an infiltration process which occurs over a shorter period of time and increases product yield.

SUMMARY OF THE INVENTION

The infiltrating binder, infiltration methods, and the bit body, bit body component, or other article of manufacture fabricated by the infiltration method, as well as other aspects of the present invention, address each of the foregoing needs.

Preferably, the infiltration method of the present invention employs a metal or a metal alloy binder which has greater strength or toughness than conventionally employed copper-based alloy binders. Cobalt and cobalt-based alloys, such as cobalt-nickel alloys, are particularly suitable for infiltrating particulate-based bit bodies. Iron-based alloys, such as iron-nickel alloys, may also be employed to infiltrate particulate-based bit bodies. Preferably, the binder also creates higher strength bonds or promotes sintering or grain growth to tungsten carbide or other particulate or powdered matrix materials than conventionally employed copper-based alloys and other conventional binders. Thus, tungsten carbide particulate-based bit bodies that have been infiltrated with the inventive binder have a relatively high strength when compared with conventional infiltrated tungsten carbide drill bits.

According to a preferred embodiment of the infiltration method of the present invention, a bit body matrix, bit body component, or other article of manufacture is formed of a powdered or particulate material. Preferably, the particulate or powdered material is refractory material, such as a metal carbide (e.g., tungsten carbide (WC), titanium carbide, tantalum carbide, etc.). Alternatively, the particulate or powdered material may include, without limitation, a tough and ductile material, such as iron, steel, Invar (i.e. a 36% nickel, iron-nickel alloy), or ceramic.

In order to effect infiltration of the matrix with the inventive binder, the binder is melted by placing same into a furnace or an induction coil, or otherwise is heated, as known in the art. Preferably, the binder is melted relatively quickly in order to facilitate infiltration over a short period of time relative to that required by many conventional infiltration processes. Accordingly, an induction coil, or induction furnace, may be employed to melt the binder. The molten binder is then imbibed into the porous matrix by gravity, by capillary action, or under differential pressure. The use of differential pressure facilitates substantially complete infiltration of the matrix by the binder, and results in a bit body that is substantially free of voids or vugs.

Following infiltration of the matrix, the bit body is cooled. As the binder cools, it binds to the matrix particles in a manner which imparts the infiltrated matrix with increased strength over that of conventional copper alloy-infiltrated matrices. Preferably, cooling is conducted in a controlled, directional fashion in order to avoid the formation of stress gradients through the infiltrated matrix, which may occur if the bit body is permitted to cool inwardly from its periphery, as explained above. Cooling of the bit body may be effected by a computer-controlled system that monitors the temperatures at various positions of the infiltrated matrix and adjusts the areas of the bit body that are being cooled and heated to effect a desired cooling pattern.

In another aspect of the invention, a non-graphite mold may be employed so as to avoid malformation of the bit body that may otherwise be caused as the cobalt or iron component of the binder attacks a graphite mold. Preferably, a mold of a nonwettable particulate or powdered material that will withstand the high infiltration temperatures and is relatively stable when exposed to the various components of the binder is employed. Exemplary particulate or powdered materials that may be used with infiltrants that include cobalt or iron include, without limitation, zircon sand, zirconium, silicon carbide, silica sand, alumina, aluminum oxide, boron nitride, and molites (which typically include mixtures of aluminum oxide and silica sand). The particles are preferably held together with a polymeric resin (e.g., a polystyrene) and supported on a graphite boat. The mold may be defined by known layered manufacturing processes, such as those disclosed in U.S. Pat. Nos. 5,433,280, which issued to Redd H. Smith on Jul. 18, 1995, and 5,544,550, which issued to Redd H. Smith on Aug. 13, 1996, the disclosures of each of which are hereby incorporated by reference in their entirety. The particulate-based mold may also be machined to correct any anisotropies in the mold cavity or to define features of the mold cavity. The mold cavity may also be coated with a layer of material such as boron nitride, ZIRCWASH, NICOBRAZE GREEN STOP-OFF, or any of the non-wettable materials that may be employed as the particulate or powdered mold material.

Other advantages of the present invention will become apparent through a consideration of the ensuing description, the drawing figures, and the appended claims.

DETAILED DESCRIPTION OF THE PREFERRED EMBODIMENTS

Figure 1:
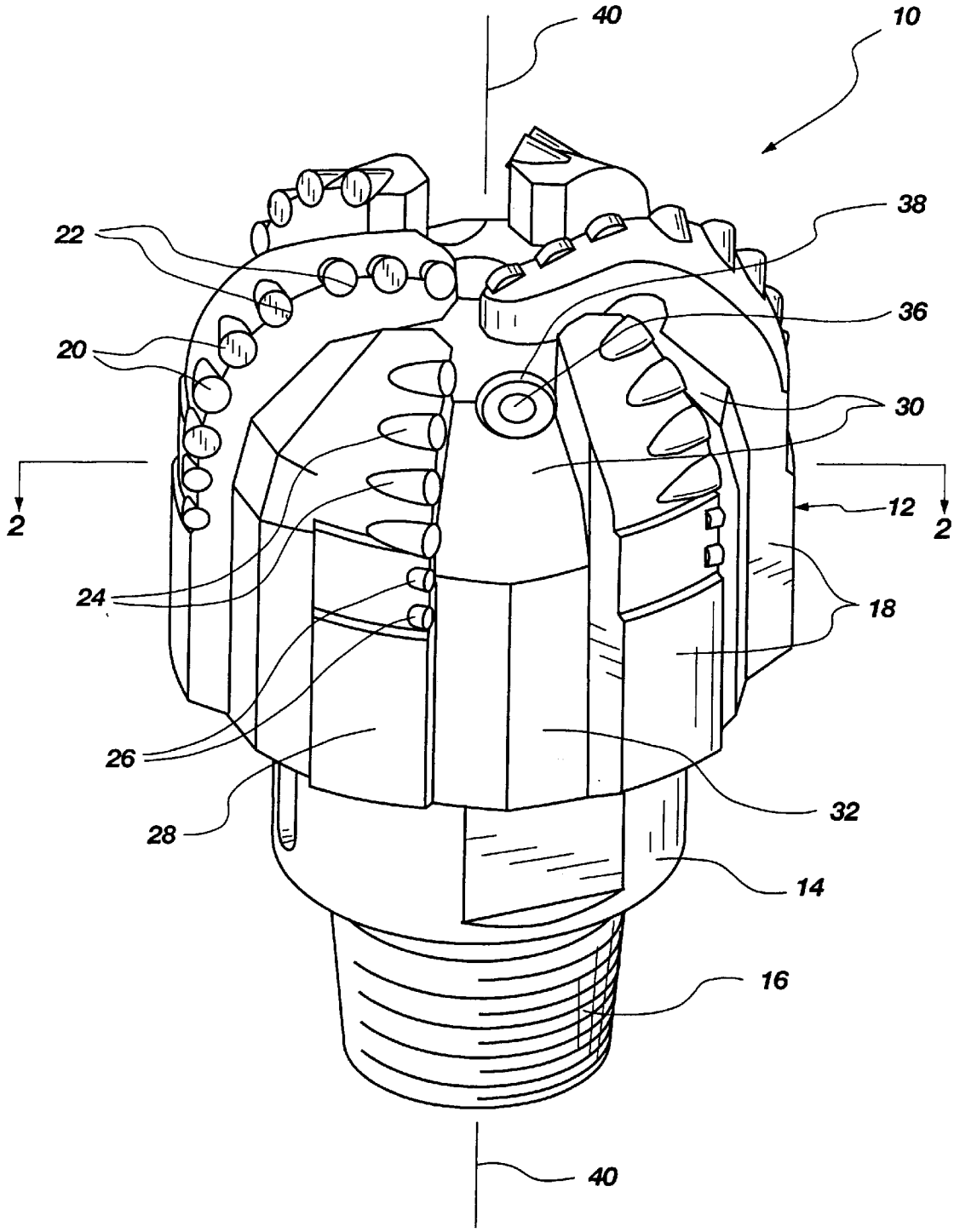
FIG. 1 is a perspective view of a drill bit according to the present invention.
Figure 2:
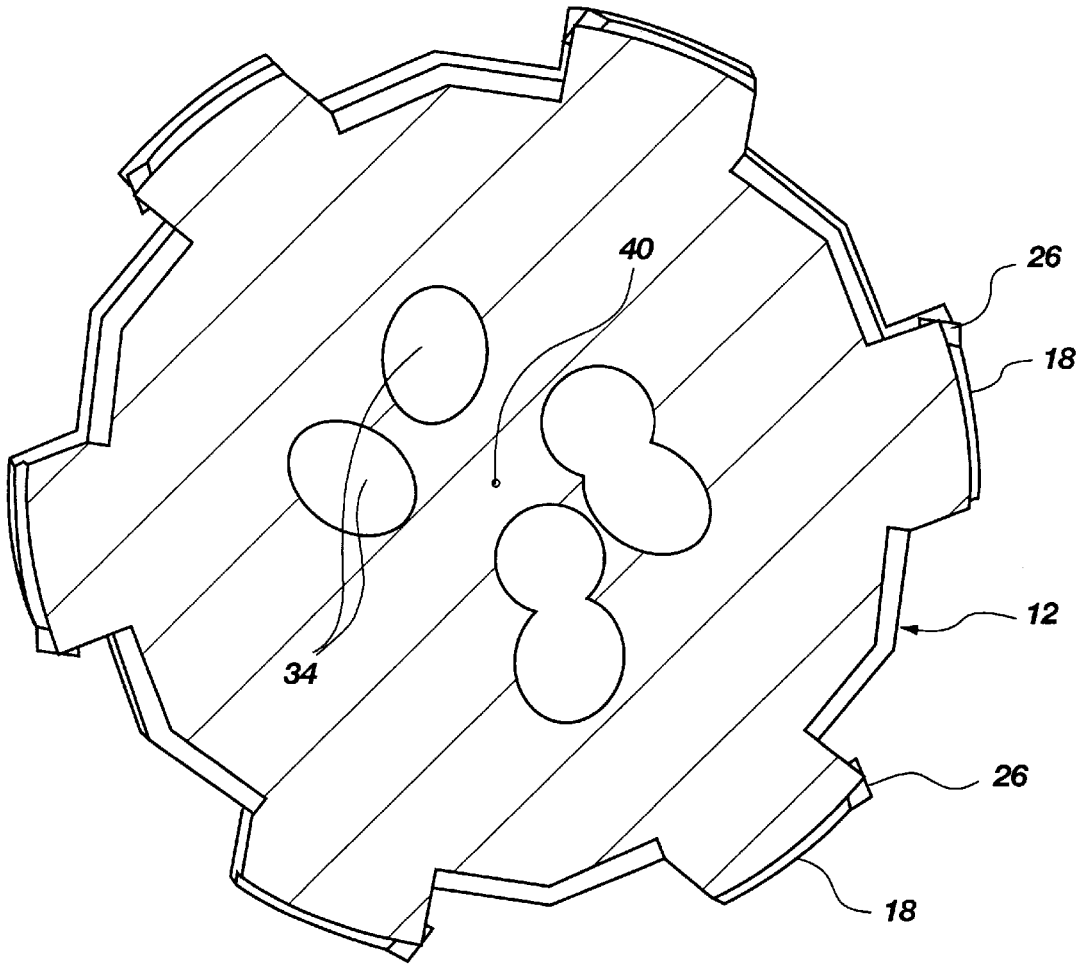
FIG. 2 is a cross-section taken along line 2—2 of FIG. 1.

FIGS. 1 and 2 illustrate an exemplary drill bit 10 that may include the inventive infiltrating binder and which may be manufactured in accordance with the inventive process. Drill bit 10, as shown, includes a variety of external and internal components, such as a bit body 12 that includes six blades or wings 18 and gage pads 28 at the periphery of the bit body. Blades 18 are separated by generally radially extending fluid courses 30, which are continuous with junk slots 32 positioned between gage pads 28. Fluid courses 30 are continuous with internal fluid passages 34.

In operation, junk slots 32 are provided with drilling fluid, or "mud," from the drill string through shank 14, which communicates with internal fluid passages 34. The "mud" exits internal fluid passages 34 through nozzles 36, which are disposed in cavities 38 defined in fluid courses 30, and is directed along the fluid courses to junk slots 32.

At the distal end of the bit body 12, blades 18 include sockets 22 with inclined rear buttresses 24. Sockets 22 carry cutting elements 20, which are supported from behind by buttresses 24. Gage trimmers 26 are set immediately adjacent and above (as depicted in FIG. 1) gage pads 28. Blades 18, fluid courses 30, and the topographical details thereof collectively define what may be termed the "bit face," being the surface of the bit which contacts the undrilled formation at the bottom of the borehole. The exterior shape of a diametrical cross section of the bit body 12 taken along the longitudinal bit axis 40 defines what may be termed the bit, or "crown," profile.

Bit body 12 is preferably formed of a particulate or powdered material, such as a refractory material (e.g., a carbide such as tungsten carbide, titanium carbide, tantalum carbide, etc.; a tough and ductile material, such as iron, steel, or Invar; or ceramic). The powdered material may be shaped to form bit body 12 by techniques that are known in the art, including, without limitation, by disposing the powdered material into a mold; by processes which employ a matrix displacing material, such as those disclosed in U.S. Pat. No. 5,090,491, which issued to Tibbitts et al. on Feb. 25, 1992, the disclosure of which is hereby incorporated by reference in its entirety; or by the layered-manufacturing processes that are disclosed in previously referenced U.S. Pat. Nos. 5,433,280 and 5,544,550. The bit bodies 12 that may be fabricated by each of these processes comprise a somewhat porous matrix, akin to a sponge or an open-celled foam. Consequently, the matrix of powdered material is relatively weak, as powdered material may be easily mechanically removed from the matrix. Accordingly, in order to form a finished drill bit 10, such as that depicted in FIGS. 1 and 2, it is necessary to infiltrate the matrix with a binder material.

Figure 3A:
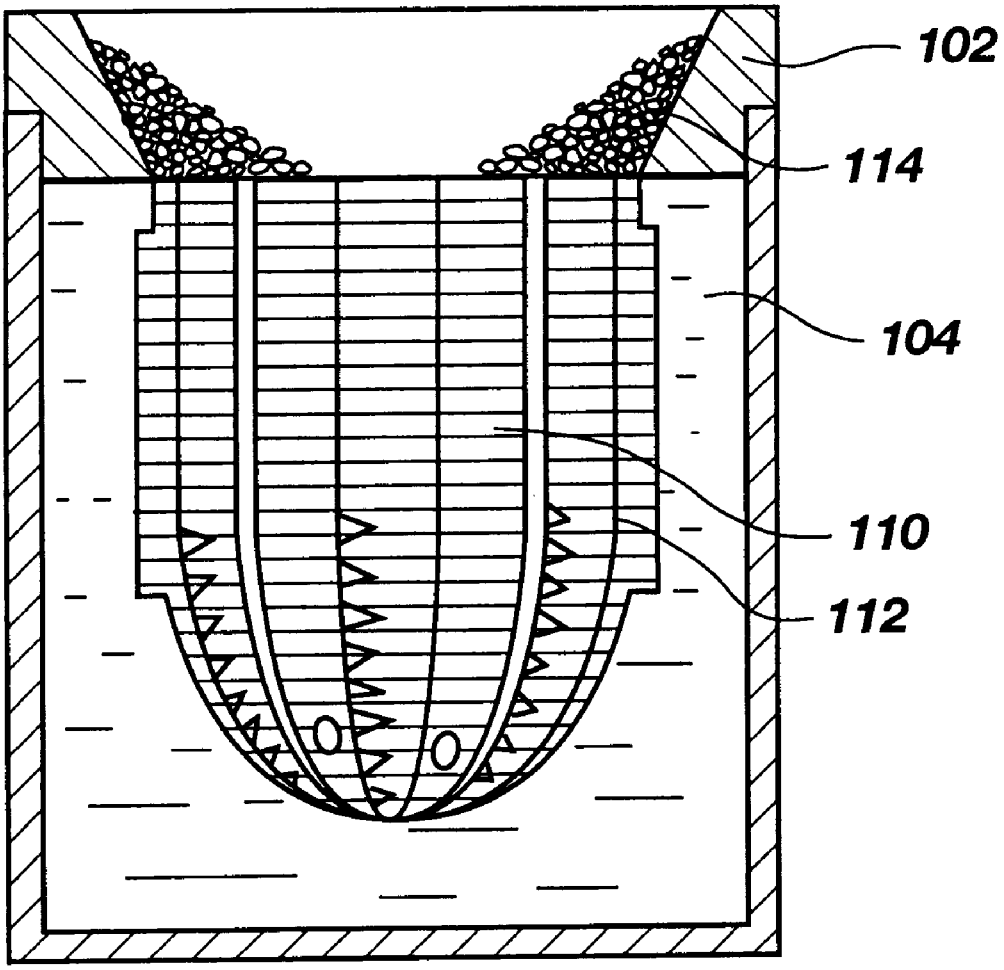
FIG. 3*a* is a schematic representation of a porous bit body matrix disposed within a mold, with a funnel having binder disposed therein attached to the top of the mold.

Referring now to FIG. 3*a*, a binder 114, which is also referred to as an infiltrant, according to the present invention comprises a metal or metal alloy that may include cobalt. Cobalt is known to form stronger bonds with refractory metal carbides, such as tungsten carbide, than the bonds formed between conventional copper-based alloys and the refractory metal carbide matrix. When a metal alloy is used as the infiltrant, the presence of nickel in the alloy is preferred, as nickel is known to those in the art to facilitate the formation of stronger bonds between the binder 114 and the powdered matrix material 112 than those formed by conventional copper-based alloys. Preferably, the infiltrant includes cobalt, such as substantially pure cobalt or a cobalt-nickel alloy. The infiltrant may also include iron or manganese.

An exemplary iron-nickel alloy that may be employed as a binder in accordance with the present invention includes about 32.5% Nickel, about 21.0% Chromium, about 0.37% Aluminum, about 0.37% Titanium, from 0 to about 1.5% Manganese, about 0.4 Silicon, from 0 to about 0.1% Carbon, the balance Iron, the percentages based on the total weight of the alloy. Such a metal alloy is available under the trade name INCOLOY® 800HT from Inco Ltd. of Toronto, Ontario, Canada. INCOLOY® 800HT has an ultimate tensile strength of about 88 kpsi and a Charpy impact strength of about 180 to about 200 ft-lbs or greater.

Similar iron-nickel alloys that are useful as binder 114, which include about 35% nickel and about 21% chromium, and which have comparable strength to INCOLOY®, include, without limitation, other iron-nickel alloys that are manufactured by Inco and marketed under the INCOLOY® trademark, such as INCOLOY® 800H, INCOLOY® 800, INCOLOY® 804, and INCOLOY® 901, iron-nickel alloys that are marketed under the trade name GANNALOY® by Inco, 425 alloy, and 1% silicon alloy (which is also available from Inco).

Another group of exemplary iron-nickel alloys that may be employed as binder 114 are sold under the trade name INVAR™ by Inco. INVAR™ alloys typically include about 36% nickel, about 63% iron, and minor amounts of manganese, silicon and carbon. More specifically, INVAR™ alloys may include a mixture of nickel, cobalt and copper which comprises about 34.5% to about 36.5% of the alloy, from 0 to about 0.1% carbon, from about 0.20% to about 0.35% silicon, and the balance iron. INVAR™ alloys typically have a tensile strength of about 80 to about 110 kpsi. The melting temperature of INVAR™ alloys is typically about 2600° F., or about 1425° C.

In order to effectively increase the strength and toughness of bit body 110, while maintaining its wear- and erosion-resistance, the bit body preferably includes approximately the same volume percentages of powdered matrix material 112 and binder 114 as conventionally infiltrated particulate-based bit bodies.

With continued reference to FIG. 3*a*, according to a preferred embodiment of the infiltration process of the present invention, a solid binder 114 is disposed adjacent a porous matrix of a bit body 110, such as in a funnel 102 that is continuous with a mold 104 in which the bit body 110 is disposed. Funnel 102 and mold 104 are preferably formed of materials that are known in the art to provide solid structural support and withstand the high temperatures of molten binder 114. Preferably, funnel 102 and mold 104 are fabricated from a resin sand that includes a polymeric resin that secures particles of a non-wettable material together. The non-wettable material of mold 104 preferably includes, but is not limited to, zircon sand, zirconium, silicon carbide, silica sand, alumina, aluminum oxide, boron nitride or any other particulate or powdered material that will withstand the high temperatures that are typically employed during infiltration and resist attack by cobalt, iron, or any other components of the binder. Alternative materials that may be employed in funnel 102 and mold 104 may include, without limitation, graphite, ceramics (e.g., COTRONICS 770) and plasters. Alternatively, another support structure, such as a non-wettable particulate material (e.g., silica sand, casting sand, graphite, ceramic powder, alumina, silicon carbide, etc.) may be disposed around a preformed, particulate-based bit body 110 matrix.

Figure 3B:
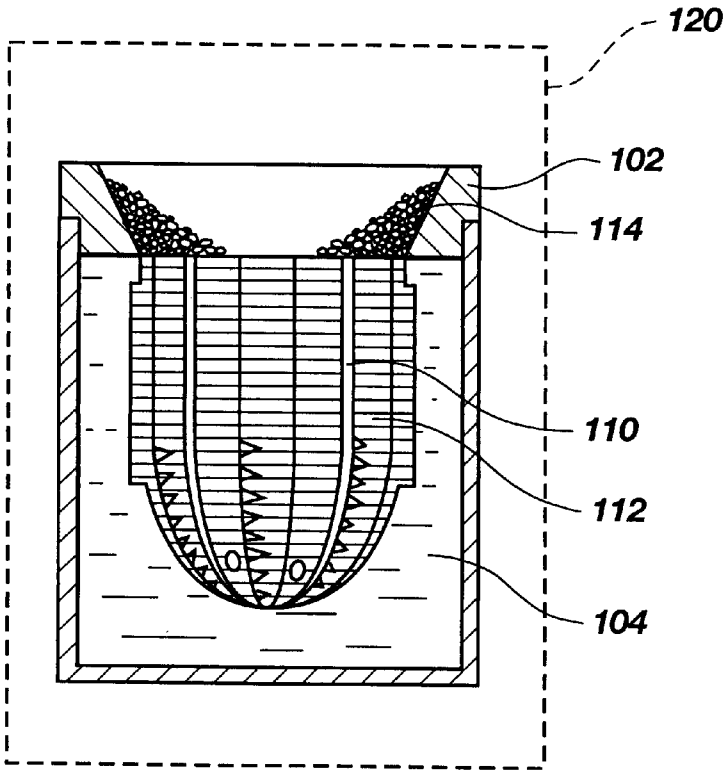
FIG. 3*b* is a schematic representation of the assembly of FIG. 3*a* disposed in a heating device.

FIG. 3*b* schematically illustrates placement of bit body 110 and binder 114 into a heating device 120, wherein the binder is melted. As binder 114 melts, it is introduced, or is imbibed, into the open spaces of the bit body 110 matrix by capillary action, under gravitational force, or under pressure. Preferably, heating device 120 is capable of generating sufficient temperatures to melt binder 114. In addition, heating device 120 preferably melts binder 114 in a relatively short period of time in order to avoid or reduce the destruction of graphite funnel 102 and mold 104 by the molten cobalt or iron of the binder.

Figure 4A:
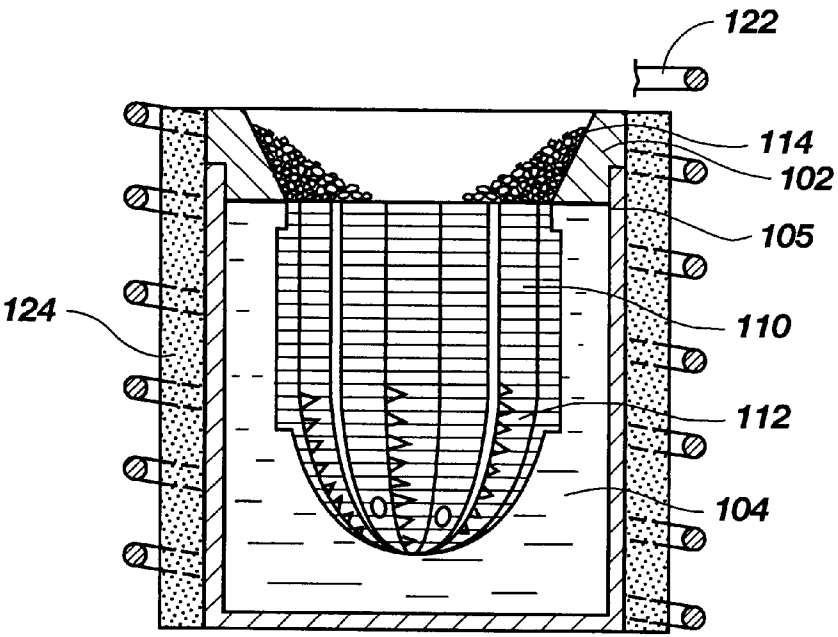
FIG. 4*a* is a schematic representation of the assembly of FIG. 3*a* disposed in an induction coil.

Referring now to FIG. 4*a*, an induction coil 122, which is also referred to as an induction furnace, and which is capable of quickly heating binder 114 to its melting temperature, is schematically illustrated. Bit body 110, which is disposed in mold 104, and binder 114, which is disposed in funnel 102, are placed within induction coil 122. Preferably, a non-wettable insulative material 124, such as silica sand, alumina, silicon carbide, zircon sand, or zirconium, is disposed within induction coil 122 around funnel 102 and mold 104. A graphite sleeve 105 may be disposed around funnel 102 and mold 104. Graphite sleeve 105 preferably comprises a thin, somewhat flexible layer of graphite, such as that sold under the trade name GRAFOIL® by UCAR Carbon Company.

As an alternating current is applied to induction coil 122, a varying magnetic field is generated which heats graphite sleeve 105 that, in turn, heats a non-graphite funnel 102 and mold 104 relatively quickly when compared with conventionally employed radiated heat, which must heat any air in the furnace, as well as any insulative material disposed around funnel 102 or mold 104 as funnel 102 and mold 104 are heated. Alternatively, if funnel 102 or mold 104 is fabricated from graphite, the funnel 102 or mold 104 may be heated directly as an alternating current flows through induction coil 122. As funnel 102 and mold 104 are heated, the binder 114 therein is heated.

Figure 4B:
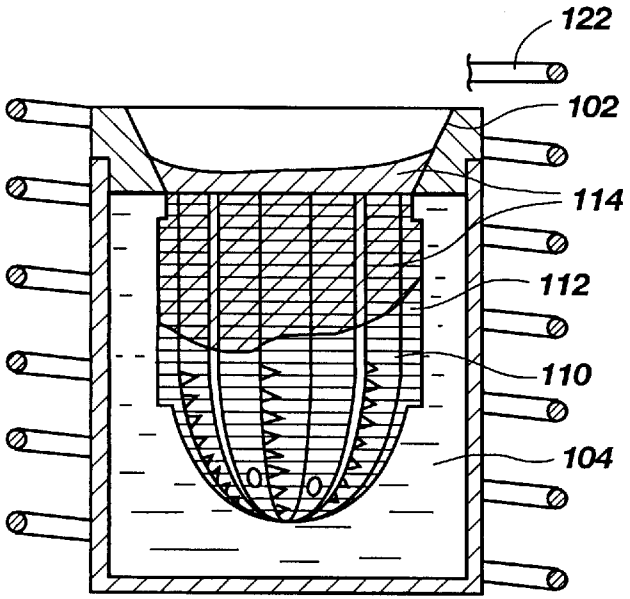
FIG. 4*b* is a schematic representation of infiltration of the porous bit body matrix by a binder, which is effected by an induction coil.

Alternatively, an induction coil may be employed to induce eddy currents in the binder 114, which is positioned within induction coil 122 and insulated therefrom by insulative material 124, funnel 102, and mold 104. The induced eddy currents directly heat binder 114, melting same. Because binder 114 is heated directly by the induced eddy currents, rather than by the temperature of funnel 102, mold 104, and the porous matrix of bit body 110 that are in contact with binder 114, the binder becomes molten relatively quickly when compared to the melting of binders by methods which employ conventional furnaces. Accordingly, as depicted in FIG. 4*b*, binder 114 infiltrates the porous matrix of bit body 110 relatively quickly when compared with the duration of conventional infiltration processes.

In a variation of the infiltration process, a powdered or particulate binder 114 may be dispersed throughout the powdered or particulate matrix material 112 of bit body 110 as the matrix material is formed into the shape of a bit body. As the bit body 110 matrix is placed within induction coil 122 and an alternating current is applied to the induction coil, particulate binder 114 melts, binding the particles of matrix material 112 to each other. In order to fill any voids or vugs in the matrix of bit body 110, additional binder 114 may also be disposed adjacent the matrix, such that it may imbibe the matrix and fill any voids or vugs that remain therein during heating.

Moreover, when a graphite funnel 102 or mold 104 is employed during infiltration, the relatively quick heating of binder 114 and infiltration of the porous matrix of bit body 110 therewith reduce the exposure of funnel 102 or mold 104 to the molten binder, which decreases the likelihood that the funnel or mold will be "attacked" or otherwise damaged by the molten binder. Accordingly, the incidence of bit bodies 110 with undesirable shapes is significantly reduced or eliminated when an induction coil 122 is employed to melt binder 114 and thereby effect infiltration of the porous matrix of bit body 110. The use of a mold 104 that is made of a material other than graphite, such as a layer-manufactured or machined resin sand mold or a castable or pourable ceramic (e.g., COTRONICS 770) or plaster, as known in the art, may further reduce the incidence of mold damage caused by binder 114.

Insulative material 124, funnel 102, and mold 104 insulate binder 114, and prevent the escape of heat therefrom during melting thereof and infiltration of the porous matrix of bit body 110 therewith. The use of a non-wettable insulative material 124, such as silica sand, also prevents molten binder 114 from escaping through any cracks or other openings that could be formed in funnel 102 or mold 104. Thus, a non-wettable insulative material 124 reduces or eliminates the incidence of excess binder 114 on the surfaces of infiltrated bit bodies 110, the removal of which would otherwise require an additional manufacturing step, or which could otherwise result in failure of bit body 110, both of which increase manufacturing costs.

Figure 5:
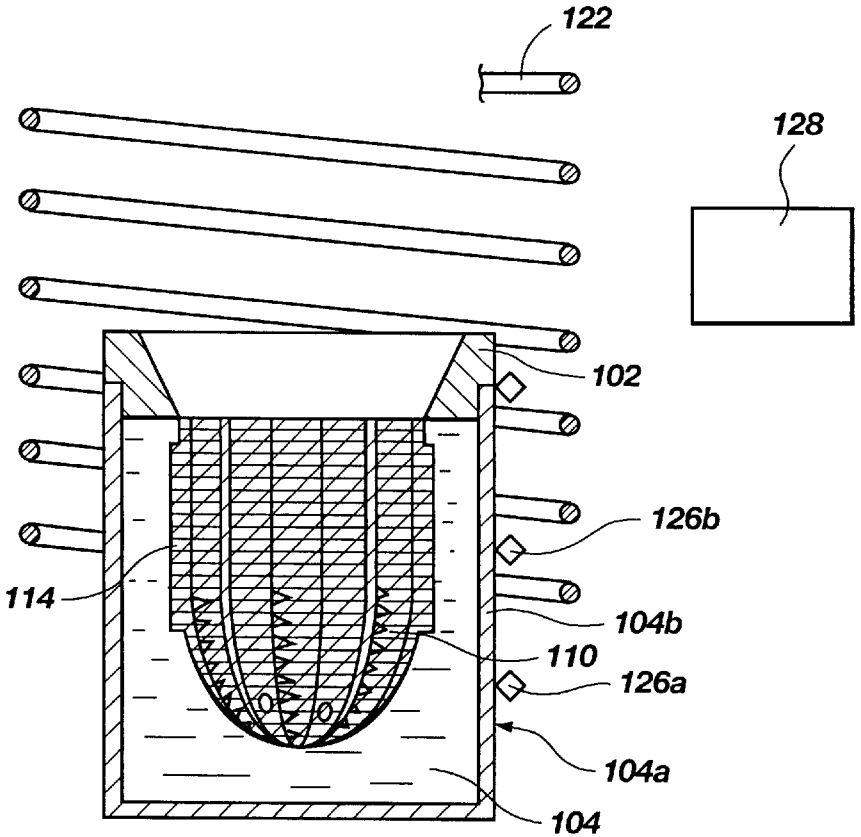
FIG. 5 is a schematic representation of the directional cooling process of the present invention, wherein the induction coil is moved longitudinally relative to the mold.

Following the infiltration of bit body 110 with binder 114, the bit body and binder are permitted to cool. Turning to FIG. 5, a preferred method of cooling an infiltrated bit body 110, which is referred to as directional cooling, is schematically illustrated. In order to effect directional cooling, an alternating current is preferably applied to induction coil 122 and binder 114 within certain regions of mold 104 (i.e., the regions of the mold that are surrounded by areas of the induction coil through which an alternating current is flowing) heated as the binder within other regions of the mold is cooled or permitted to cool.

The regions of mold 104 that are surrounded by a magnetic current-generating induction coil 122 at a given point in time are collectively referred to as the "heating zone". The regions of mold 104 that are not surrounded by a magnetic current-generating induction coil 122 are collectively referred to as the "cooling zone." Thus, as binder 114 within mold 104 cools, the "cooling zone" around mold 104 expands directionally (e.g., upwardly) while the "heating zone" is moved in the same direction.

Preferably, induction coil 122 may be moved longitudinally relative to mold 104 in order to effect directional cooling. Induction coil 122 may be moved upward relative to the bottom region 104*a* of mold 104 to permit binder 114 within the bottom region 104*a* to cool and begin solidifying. As binder 114 within bottom region 104*a* of mold 104 cools to a desirable temperature, which may be measured by a temperaturesensing element 126*a*, such as a thermocouple, disposed proximate the bottom region 104*a* of mold 104, induction coil 122 is moved upwardly relative to the mold, permitting binder 114 within a second region 104*b* of mold 104, adjacent bottom region 104*a*, to cool. When another temperature-sensing element 126*b* disposed proximate second region 104*b* detects that the binder 114 within the second region of mold 104 has cooled to a desirable temperature, induction coil 122 is again moved upwardly relative to the mold 104. Such upward movement of induction coil 122, and the consequential directional cooling of binder 114, is continued until all of the binder in mold 104 and any binder remaining in funnel 102 has been cooled.

Preferably, the longitudinal movement of induction coil 122 relative to mold 104 is controlled by a computer 128, which monitors the temperatures that are measured by each temperature sensing element 126. Thus, the "heating zone" and "cooling zone" may be moved relative to mold 104 to effect a desired pattern of cooling binder 114, which may be determined by computer 128 in accordance with programming thereof. Alternatively, the movement of induction coil 122 relative to mold 104 may be effected manually, in increments based on the temperature of the various regions of mold 104, in timed increments, or at a continual rate.

Alternatively, the direction of cooling may be downwardly from the top of mold 104, rather than upwardly from the bottom of mold 104. If cooling moves downward along mold 104, mold 104 preferably includes a source from which molten binder may be pulled into the bottom of the mold cavity. As another alternative, mold 104 may be moved longitudinally relative to induction coil 122.

In a variation of the directional cooling method, rather than move induction coil 122 relative to funnel 102 and mold 104, the region of induction coil 122 that generates a magnetic current may be decreased by selectively eliminating the current through one or more other regions of induction coil 122. Thus, the heating zone includes those regions of induction coil 122 through which a current flows, while the cooling zone includes the regions of induction coil 122 through which no current flows.

Figure 6:
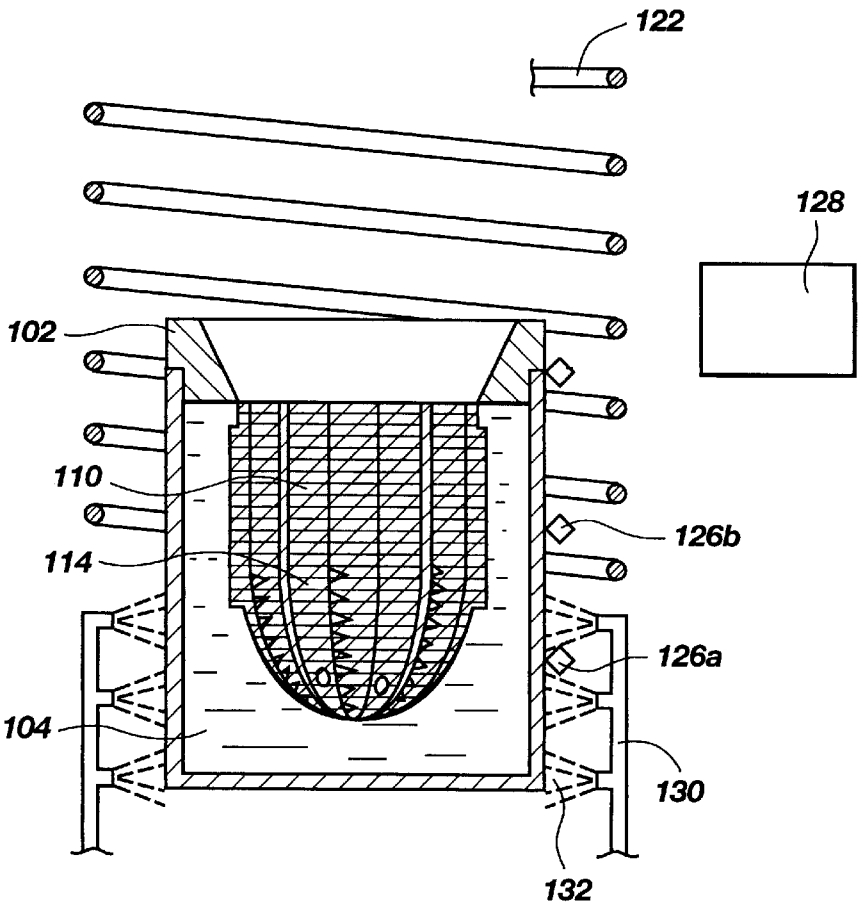
FIG. 6 is a schematic representation of a variation of the directional cooling process, which includes the longitudinal movement of the induction coil of FIG. 5 and a cooling system relative to the mold.

With reference to FIG. 6, another variation of the directional cooling method of the present invention may include a coolant system 130, which exposes the various regions of mold 104 that are in the "cooling zone" to coolant 132, such as water, ethylene glycol, or other known coolants. As coolant 132 contacts mold 104, the coolant transfers heat away from the mold and thus from the binder 114 therein, cooling the binder. Coolant 132 may be sprayed onto mold 104, circulated past the mold in a closed system, or circulated through passageways in the mold. Preferably, cooling system 130 may be moved longitudinally relative to mold 104, and remains a fixed distance from induction coil 122 as the induction coil is moved upward relative to mold 104.

Figure 7:
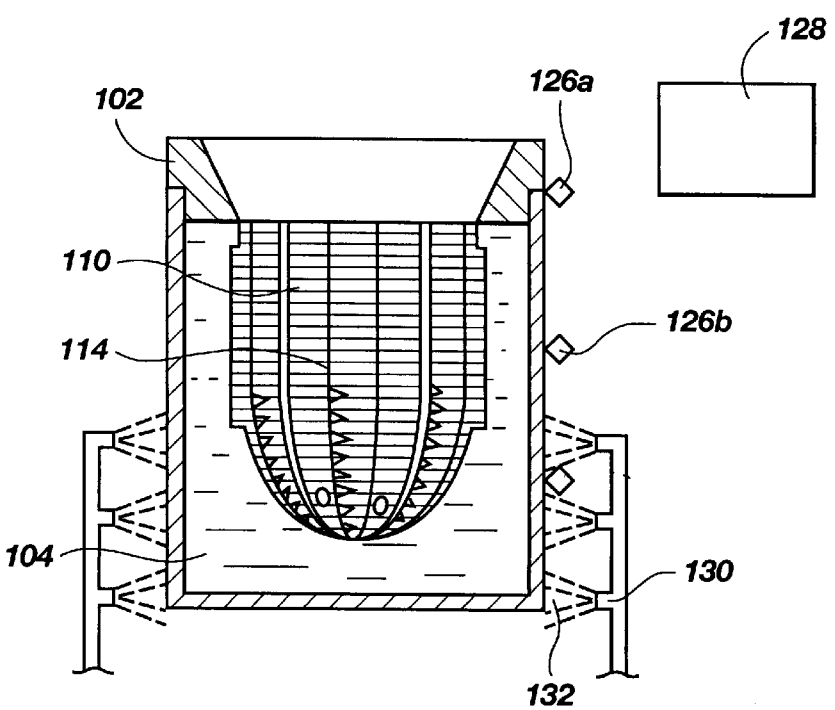
FIG. 7 is a schematic representation of another variation of the directional cooling process, wherein a cooling system is moved longitudinally relative to the mold.

In yet another variation of the directional cooling method, with reference to FIG. 7, cooling system 130 may be utilized to directionally cool binder 114 after mold 104 has been removed from induction coil 122. Accordingly, a computer 128, which monitors the temperatures that are measured by temperature sensing elements 126 at various regions of mold 104, would direct the movement of cooling system 130, and the corresponding expansion of the "cooling zone," relative to mold 104 in order to effect a desired cooling pattern. In this variation of the directional cooling method, since none of the binder 114 is heated by the induction coil, no "heating zone" is generated.

Alternatively, the movement of cooling system 130 may be effected manually in increments based on the temperature of the various regions of mold 104, in timed increments, or at a constant rate. Cooling may occur downwardly from the top of mold 104, rather than upwardly from the bottom of the mold so long as molten binder may be supplied to the mold cavity. As another alternative, mold 104 may be moved longitudinally relative to cooling system 130.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of this invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A method of directionally cooling a molten portion of a drilling-related component, comprising:

providing a drilling-related component including at least a molten portion encompassed by a heating zone positioned at least partially along a longitudinal axis of said drilling-related component; and adjusting said heating zone along said longitudinal axis so as to promote cooling of a longitudinal region of said drilling-related component.

2. The method of claim 1, wherein said adjusting comprises decreasing a length of said heating zone relative to said drilling-related component, from a length encompassing an entirety of said drilling-related component to another length encompassing an end region of said drilling related component.

3. The method of claim 2, wherein said decreasing comprises longitudinally moving at least one of the drilling-related component and an induction coil surrounding the drilling-related component relative to the other.

4. The method of claim 1, wherein an area of said drilling-related component which is not surrounded by said heating zone comprises a cooling zone.

5. The method of claim 4, further comprising removing heat from a molten portion of said drilling-related component located within said cooling zone with a coolant.

6. The method of claim 1, further comprising:

monitoring the temperatures of a plurality of regions of said drilling-related component with a computer; and effecting decrease in size of said heating zone with said computer relative to a cooling pattern.

7. The method of claim 1, wherein said heating zone comprises a magnetic field generated by an induction coil surrounding at least a portion of said drilling-related component.

* * * * *

UNITED STATES PATENT AND TRADEMARK OFFICE

CERTIFICATE OF CORRECTION

PATENT NO. : 6,220,117 B1
DATED : April 24, 2001
INVENTOR(S) : Trent N. Butcher

It is certified that error appears in the above-identified patent and that said Letters Patent is hereby corrected as shown below:

Title page,
Item [56], References Cited, U.S. PATENT DOCUMENTS, at "5,839,329" before "11/1998" delete "*"; at "3,575,878" before "9/1973" delete "*";
OTHER PUBLICATIONS, delete "!".

Column 2,
Line 18, delete the comma after "infiltration"

Column 3,
Line 60, change "otherwise is" to -- is otherwise --

Column 4,
Line 21, change "nonwettable" to -- non-wettable --

Column 6,
Line 11, change "0.4" to -- 0.4% --

Column 8,
Line 57, change "temperaturesensing" to -- temperature-sensing --

Column 9,
Line 6, change "126" to -- 126a, 126b --
Line 48, change "126" to -- 126a, 126b --

Column 10,
Line 33, change "drilling related" to -- drilling-related --

Signed and Sealed this

Sixth Day of January, 2004

JAMES E. ROGAN
*Director of the United States Patent and Trademark Office*